US006471320B2

(12) United States Patent
Anderson

(10) Patent No.: US 6,471,320 B2
(45) Date of Patent: Oct. 29, 2002

(54) DATA BANDWIDTH REDUCTION TO PRINTHEAD WITH REDUNDANT NOZZLES

(75) Inventor: Daryl E. Anderson, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/803,403

(22) Filed: Mar. 9, 2001

(65) Prior Publication Data

US 2002/0126168 A1 Sep. 12, 2002

(51) Int. Cl.[7] ..... B41J 29/38
(52) U.S. Cl. ..... 347/12; 347/9
(58) Field of Search ..... 347/9–13, 40, 347/42, 5

(56) References Cited

U.S. PATENT DOCUMENTS

| | | | | |
|---|---|---|---|---|
| 4,463,359 A | | 7/1984 | Ayata et al. | 346/1.1 |
| 4,595,935 A | | 6/1986 | Brooks et al. | 346/76 PH |
| 4,695,853 A | | 9/1987 | Hackleman et al. | 346/140 R |
| 4,695,854 A | | 9/1987 | Cruz-Uribe | 346/140 R |
| 4,719,477 A | | 1/1988 | Hess | 346/140 R |
| 4,764,659 A | | 8/1988 | Minami et al. | 219/216 |
| 4,882,686 A | * | 11/1989 | Gretter | 364/518 |
| 4,982,199 A | | 1/1991 | Dunn | 346/1.1 |
| 4,999,650 A | | 3/1991 | Braun | 346/140 R |
| 5,016,023 A | | 5/1991 | Chan et al. | 346/1.1 |
| 5,030,971 A | | 7/1991 | Drake et al. | 346/140 R |
| 5,049,898 A | | 9/1991 | Arthur et al. | 346/1.1 |
| 5,103,246 A | | 4/1992 | Dunn | 346/140 R |
| 5,327,165 A | | 7/1994 | Elliott | 346/76 PH |
| 5,363,134 A | | 11/1994 | Barbehenn et al. | 347/49 |
| 5,365,312 A | | 11/1994 | Hillmann et al. | 355/206 |
| 5,371,530 A | | 12/1994 | Hawkins et al. | 347/9 |
| 5,541,629 A | | 7/1996 | Saunders et al. | 347/12 |
| 5,604,513 A | | 2/1997 | Takahashi et al. | 345/153 |
| 5,610,635 A | | 3/1997 | Murray et al. | 347/7 |
| 5,646,660 A | | 7/1997 | Murray | 347/59 |
| 5,648,804 A | | 7/1997 | Keefe et al. | 347/47 |
| 5,742,305 A | * | 4/1998 | Hackleman | 347/12 |
| 5,815,172 A | | 9/1998 | Moh | 347/14 |
| 5,815,180 A | | 9/1998 | Barbour et al. | 347/59 |
| 5,886,718 A | | 3/1999 | Johnson et al. | 347/85 |
| 5,946,012 A | | 8/1999 | Courian et al. | 347/63 |
| 6,091,891 A | | 7/2000 | Overall et al. | 395/112 |
| 6,109,716 A | | 8/2000 | Takahashi | 347/11 |
| 6,126,261 A | | 10/2000 | Yamanaka | 347/12 |
| 6,178,009 B1 | | 1/2001 | Yamada et al. | 358/1.9 |
| 6,193,345 B1 | | 2/2001 | Feinn et al. | 347/12 |

FOREIGN PATENT DOCUMENTS

| | | | |
|---|---|---|---|
| EP | 0547921 A2 | 6/1993 | B41J/2/175 |
| JP | 07242004 | 3/1994 | B41J/2/30 |
| JP | 08127140 | 10/1994 | B41J/2/30 |

* cited by examiner

*Primary Examiner*—Anh T. N. Vo
*Assistant Examiner*—An H. Do

(57) ABSTRACT

A printhead includes a first nozzle column register and logic units configured to receive first serial nozzle data and to provide first nozzle firing control signals for controlling the firing of ink drops from a first column of nozzles. Second nozzle column register and logic units are configured to receive the first serial nozzle data and to provide second nozzle firing control signals for controlling the firing of ink drops from a second column of nozzles. First column redundancy logic is configured to disable selected nozzles of the first column of nozzles from firing. Second column redundancy logic is configured to disable selected nozzles of the second column of nozzles from firing.

20 Claims, 4 Drawing Sheets

DATA BANDWIDTH REDUCTION TO PRINTHEAD WITH REDUNDANT NOZZLES

CROSS-REFERENCE TO RELATED APPLICATIONS

This Non-Provisional Patent Application is related to commonly assigned U.S. patent application Ser. No. 09/253,411, filed on Feb. 19, 1999, entitled "A HIGH PERFORMANCE PRINTING SYSTEM AND PROTOCOL," and which is herein incorporated by reference.

THE FIELD OF THE INVENTION

The present invention relates generally to inkjet printheads, and more particularly to reducing data bandwidth to inkjet printheads.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead or electronic controller typically located as part of the processing electronics of a printer, controls activation of an electrical current from a power supply external to the printhead. The electrical current is passed through a selected thin film resister to heat the ink in a corresponding selected vaporization chamber.

Advanced printhead designs now permit an increased number of nozzles to be implemented on a single printhead. As the number of nozzles increases, an overall number of ink drops which can be ejected per second is increased. Since the overall number of drops which can be ejected per second is increased, printing speed can be increased as long as the data rate or bandwidth to the printhead is correspondingly increased.

As the number of nozzles on a single printhead increases, the number of corresponding thin film resisters which need to be electrically coupled to the remote printhead controller correspondingly increases, which results in a correspondingly large number of conductive paths carrying nozzle data and other data signals to the printheads in order to maintain sufficient bandwidth to the printhead. Furthermore, the number of drivers in the electronic controller necessary to transmit the nozzle data and other data signals from the electronic controller to the printhead is also increased to maintain sufficient bandwidth to the printhead. In addition, a corresponding increased number of input pads are required on the printhead to receive the nozzle data and other data signals at the increased bandwidth.

Voltage switching in the large number of signals carried on the conductive paths required for sufficient bandwidth generates undesirable electromagnetic interference (EMI). In addition, the ejection of ink from the nozzles (i.e., firing of the nozzles) requires a switching on and off of a large amount of electrical current in a short amount of time. The switching on and off of nozzle current of a large number of nozzles simultaneously generates undesirable EMI.

The EMI generated as a result of voltage switching in the signals carried on the conductive paths and nozzle firing causes conductive paths, such as cables, to conduct and/or radiate undesirable EMI. EMI is undesirable because EMI interferes with internal components of the printing system and can also interfere with other electric devices and appliances not associated with the printing system, such as computers, radios, and televisions. Moreover, systems, such as printing systems, typically need to comply to an electromagnetic compliance (EMC) standard which defines limits to levels of stray EMI noise signals. For example, EMC standards are set by government regulatory agencies, such as the Federal Communications Commission (FCC), which set electrical emission standards for electric devices.

Data rates or bandwidth to printheads can also be increased by increasing the speed at which the data is transmitted from the electronic controller to the printhead. Nevertheless, signal integrity of nozzle data and other data signals communicated from the electronic controller to the printhead typically degrades as the speed of the signal increases.

For reasons stated above and for other reasons presented in greater detail in the Description of the Preferred Embodiment section of the present specification, an inkjet printing system is desired which reduces bandwidth of nozzle data communicated from the electronic controller to the printhead, yet maintains desired high speed printing rates.

SUMMARY OF THE INVENTION

One aspect of the present invention provides a printhead including a first column of nozzles and a second column of nozzles. First nozzle column register and logic units are configured to receive first serial nozzle data and to provide first nozzle firing control signals for controlling the firing of ink drops from the first column of nozzles. Second nozzle column register and logic units are configured to receive the first serial nozzle data and to provide second nozzle firing control signals for controlling the firing of ink drops from the second column of nozzles. First column redundancy logic is configured to disable selected nozzles of the first column of nozzles from firing which correspond to selected nozzles of the second column of nozzles enabled for firing. Second column redundancy logic is configured to disable selected nozzles of the second column of nozzles from firing which correspond to selected nozzles of the first column of nozzles enabled for firing.

One aspect of the present invention provides a printhead assembly having at least one printhead. Each printhead includes a first column of nozzles and a second column of nozzles. First nozzle column register and logic units are configured to receive first serial nozzle data and to provide first nozzle firing control signals for controlling the firing of ink drops from the first column of nozzles. Second nozzle column register and logic units are configured to receive the first serial nozzle data and to provide second nozzle firing control signals for controlling the firing of ink drops from the second column of nozzles. First column redundancy logic is configured to disable selected nozzles of the first column of nozzles from firing which correspond to selected nozzles of the second column of nozzles enabled for firing. Second column redundancy logic is configured to disable selected nozzles of the second column of nozzles from firing which correspond to selected nozzles of the first column of nozzles enabled for firing.

One aspect of the present invention provides a method of operating a printhead including receiving first serial nozzle data with first nozzle column register and logic units, and providing first nozzle firing control signals with first nozzle column register and logic units for controlling the firing of ink drops from a first column of nozzles. The method includes receiving the first serial nozzle data with second nozzle column register and logic units, and providing second nozzle firing control signals with second nozzle column register and logic units for controlling the firing of ink drops from a second column of nozzles. The method includes disabling selected nozzles of the first column of nozzles from firing which correspond to selected nozzles of the second column of nozzles enabled for firing, and disabling selected nozzles of the second column of nozzles from firing which correspond to selected nozzles of the first column of nozzles enabled for firing.

In one embodiment of the method, the first column of nozzles includes N nozzles numbered 1 through N and the second column of nozzles includes N nozzles numbered 1 through N. In one embodiment, the disabling steps operate so that only one nozzle for a given nozzle number is enabled for firing across the first and second columns.

In one embodiment, the method includes receiving first redundant data for programming first column redundancy logic, and receiving second redundant data for programming second column redundancy logic. In one embodiment, the method includes receiving the first and second redundant data at first input pads during a configuration cycle, and receiving the nozzle data at the first input pads during a printing operation. In one embodiment, the method includes providing the first and second redundant data from the first input pads to the first and second column redundancy logic during the configuration cycle, and providing the first nozzle data from the input pads to the first and second nozzle column register and logic units during the printing operation.

In one embodiment, the method includes storing first redundancy states for the first column of nozzles, and storing second redundancy states for the second column of nozzles. In one embodiment, the method includes combining the first redundancy states with the first nozzle firing control signals, and combining the second redundancy states with the second nozzle firing control signals. In one embodiment, the combining steps are performed with AND gates.

The redundancy logic of the printhead according to the present invention permits a reduction in nozzle data rate or bandwidth by a factor of two or more for inkjet printheads that have multiple columns employed redundantly. The amount of reduced bandwidth tracks the number of columns of redundant nozzles. The significant reduction in nozzle data bandwidth to the printhead correspondingly significantly reduces the required number of conductors necessary to carry nozzle data to the printhead. The number of drivers in the electronic controller of the inkjet printing system necessary to transmit the nozzle data from the electronic controller to the printhead is also proportionally reduced. The reduction in nozzle data bandwidth to the printhead also proportionally reduces the number of required nozzle data input pads on the printhead to receive the nozzle data from the electronic controller. Moreover, the reduced number of nozzle data conductors in the electrical interconnect between the electronic controller and the printhead assembly correspondingly reduces the amount of undesirable electromagnetic interference (EMI) conducted and/or radiated by the nozzle data conductors. The reduced nozzle data bandwidth could also allow for lower speed signaling of the nozzle data transmission from the electronic controller to the printhead, which would correspondingly increase the signal integrity of the nozzle data signals communicated from the electronic controller to the printhead.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading, " "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
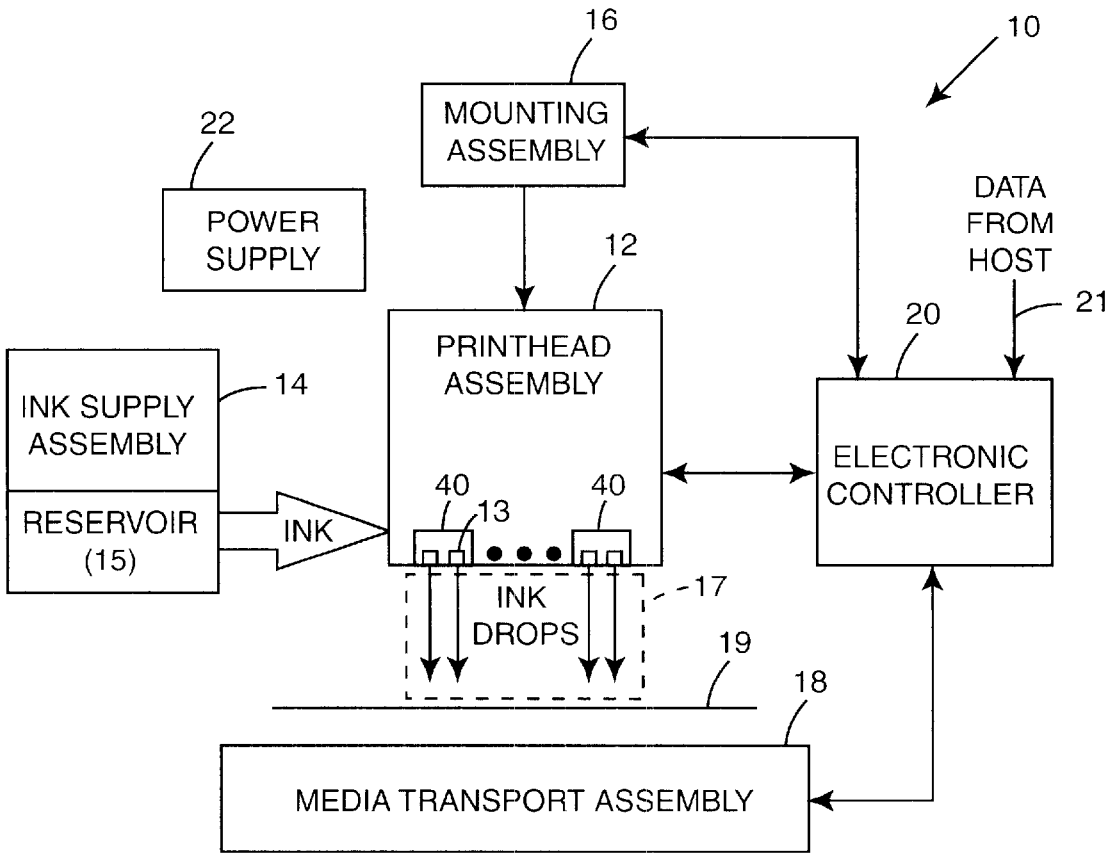
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
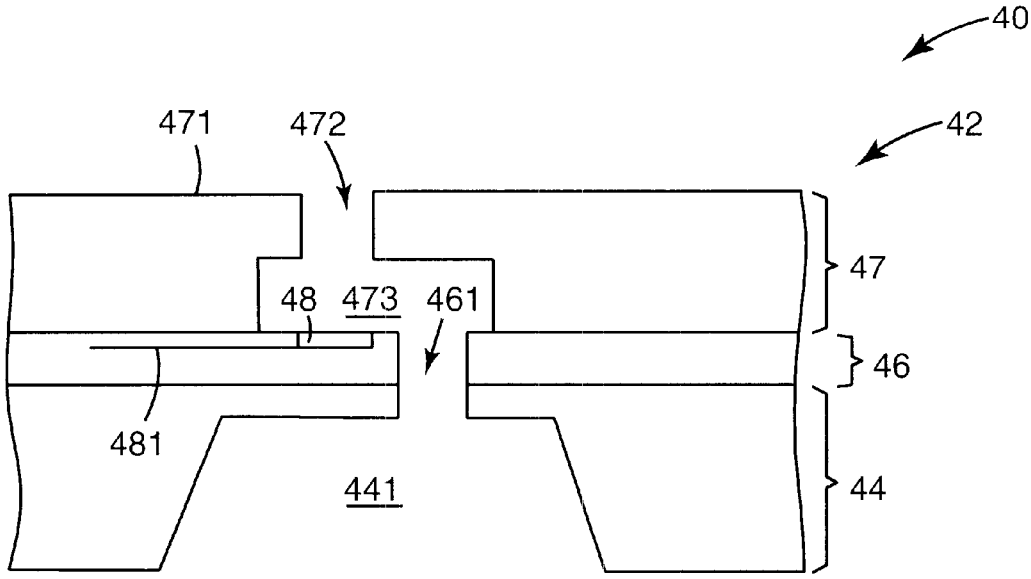
FIG. 2 is an enlarged schematic cross-sectional view illustrating portions of one embodiment of a printhead die in the printing system of FIG. 1.

A portion of one embodiment of a printhead die 40 is illustrated schematically in FIG. 2. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Printhead assembly 12 can include any suitable number (N) of printheads 40, where N is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
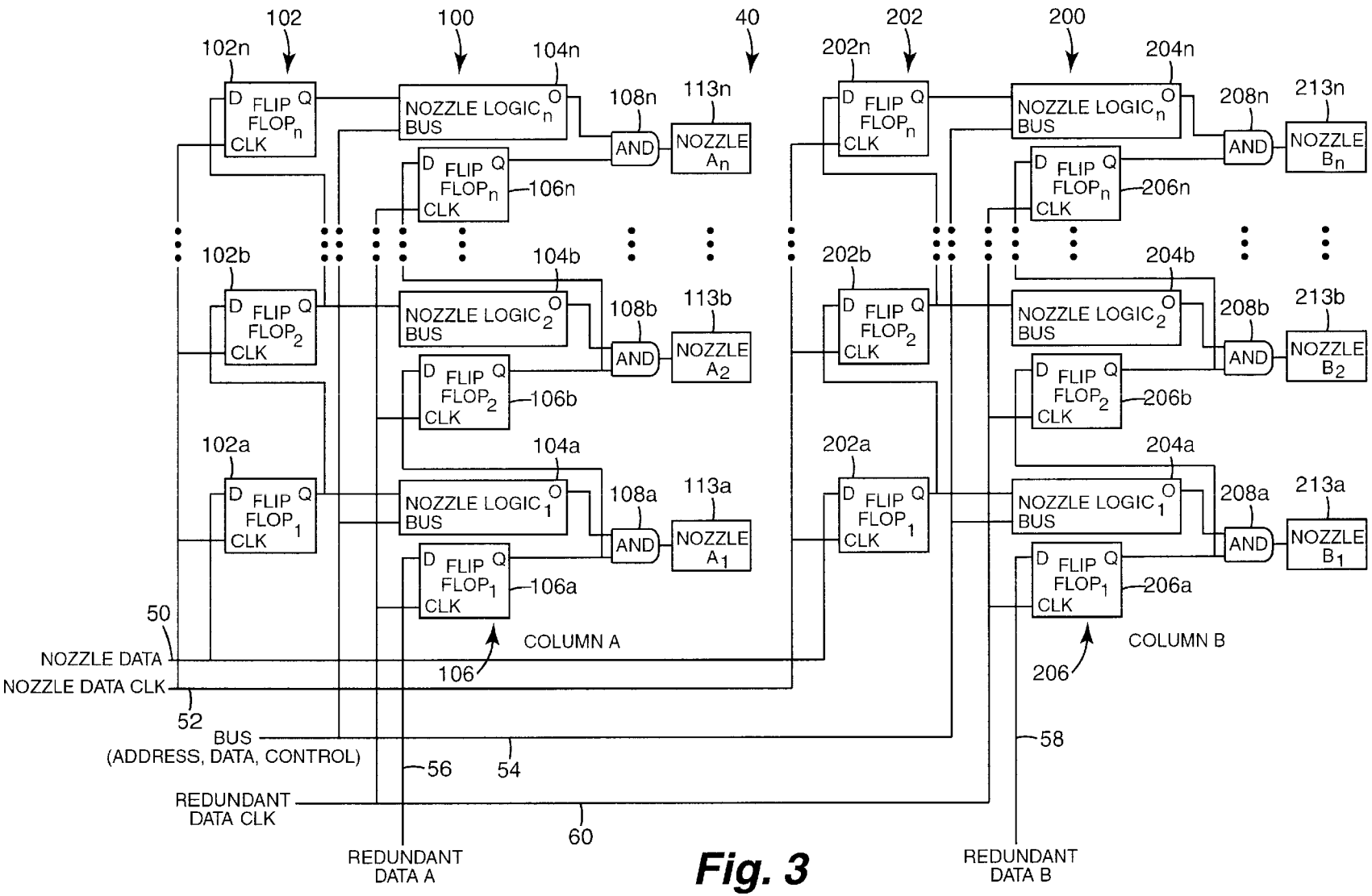
FIG. 3 is a block diagram illustrating portions of one embodiment of an inkjet printhead having redundant nozzles and configured to permit a reduced data bandwidth to the printhead according to the present invention.

Portions of one embodiment of a printhead 40 according to the present invention are illustrated generally in block diagram form in FIG. 3. The embodiment of printhead 40 illustrated in FIG. 3 includes a Column A of nozzles and associated registers and logic generally indicated at 100 and a Column B of nozzles and associated registers and logic generally indicated at 200. Column A includes Nozzles 113*a*, 113*b*, . . . ,113*n*. Column B includes N nozzles 213*a*, 213*b*, . . . ,213*n*.

Nozzle data is serially provided to a shift register 102 in Column A and a shift register 202 in Column B on a path 50. Shift register 102 comprises N flip-flop registers 102*a*, 102*b*, . . . ,102*n*. Shift register 202 comprises N flip-flop registers 202*a*, 202*b*, . . . ,202*n*. A nozzle data clock is provided to each of the flip-flop registers 102*a*–102*n* and flip-flop registers 202*a*–202*n* via a clock line 52 to clock the nozzle data into the flip-flop registers.

Shift registers 102 and 202 operate as follows. The serial nozzle data on line 50 is provided to the D input of flip-flop register 102*a* and the D input of flip-flop register 202*a*. The Q output of flip-flop register 102*a* is provided to the D input of flip-flop register 102*b* and the Q output of flip-flop register 202*a* is provided to the D input of flip-flop register 202*b*, . . . , and the Q output of the 102*n*−1 flip-flop register is provided to the D input of flip-flop register 102*n* and the Q output of flip-flop register 202*n*−1 is provided to the D input of flip-flop register 202*n*. In this way, the nozzle data is shifted through shift registers 102 and 202.

The Q output from each of D flip-flop registers 102*a*–102*n* is respectively provided to a corresponding nozzle logic 104*a*, 104*b*, . . . , 104*n*. The Q output from each flip-flop register 202*a*–202*n* is respectively provided to an corresponding nozzle logic 204*a*, 204*b*, . . . ,204*n*. Addresses, data, and control are provided on an internal bus to nozzle logic 104*a*–104*n* and to nozzle logic 204*a*–204*n*. In the embodiment illustrated in FIG. 3, addresses, data, and control are all provided on shared internal bus 54, and signals indicate whether data or addresses or control are on the shared bus 54 at a given time. Other embodiments of printhead 40 have separate address, data, and/or control busses.

In one embodiment, command data from electronic controller 20 which is independent of nozzle data is provided to and status data read from printhead 40 over a serial bi-directional non-print data serial bus. In this embodiment, electronic controller 20 can access and control nozzle logic 104/204 via the bi-directional non-print data serial bus which communicates serial data to and from internal bus 54.

The nozzle data provided to nozzle logic 104/204 represents the characters, symbols, and/or other graphics or images to be printed. In one embodiment, nozzle logic 104/204 also generates a nozzle address, which the nozzle logic combines with the nozzle data to control the sequence of which nozzle is to be fired at a given time (i.e., the nozzle firing order). In one embodiment, nozzle logic 104/204 receives a fire pulse, which the nozzle logic combines with the nozzle data to control the timing of the activation of electrical current from a power supply external to the printhead, such as power supply 22 (shown in FIG. 1) to thereby control the timing of ejection of ink drops from the nozzles.

The output of each nozzle logic 104*a*–104*n* and 204*a*–204*n* is a nozzle control signal for controlling the firing of the respective nozzles 113*a*–13*n* and 213*a*–213*n*.

For redundancy control, Column A includes N flip-flop registers, 106*a*, 106*b*, . . . ,106*n* which are collectively referred to as redundant shift register 106. Similarly, Column B includes redundant N flip-flop registers 206*a*, 206*b*, . . . ,206*n* which are collectively referred to as redundant shift register 206. Serial redundant data A is provided to the D input of flip-flop register 106*a* via path 56. The Q output of flip-flop register 106a is provided to the D input of flip-flop register 106*b*, . . . , and the Q output of 106*n*−1 is provided to the D input of flip-flop register 106*n*. Similarly, serial redundant data B is provided to the D input of flip-flop register 206*a* via path 58. The Q output of flip-flop register 206*a* is provided to the D input of flip-flop register 206*b*, . . . , and the Q output of flip-flop register 206*n*−1 is provided to the D input to flip-flop register 206*n*. Redundant flip-flop registers 106*a*–106*n* and flip-flop registers 206*a*–206*n* are each clocked by a redundant data clock provided on a clock line 60. In this way, redundant data A is shifted into flip-flop registers 106*a*–106*n* and redundant data B is shifted into flip-flop registers 206*a*–206*n*.

Figure 4:
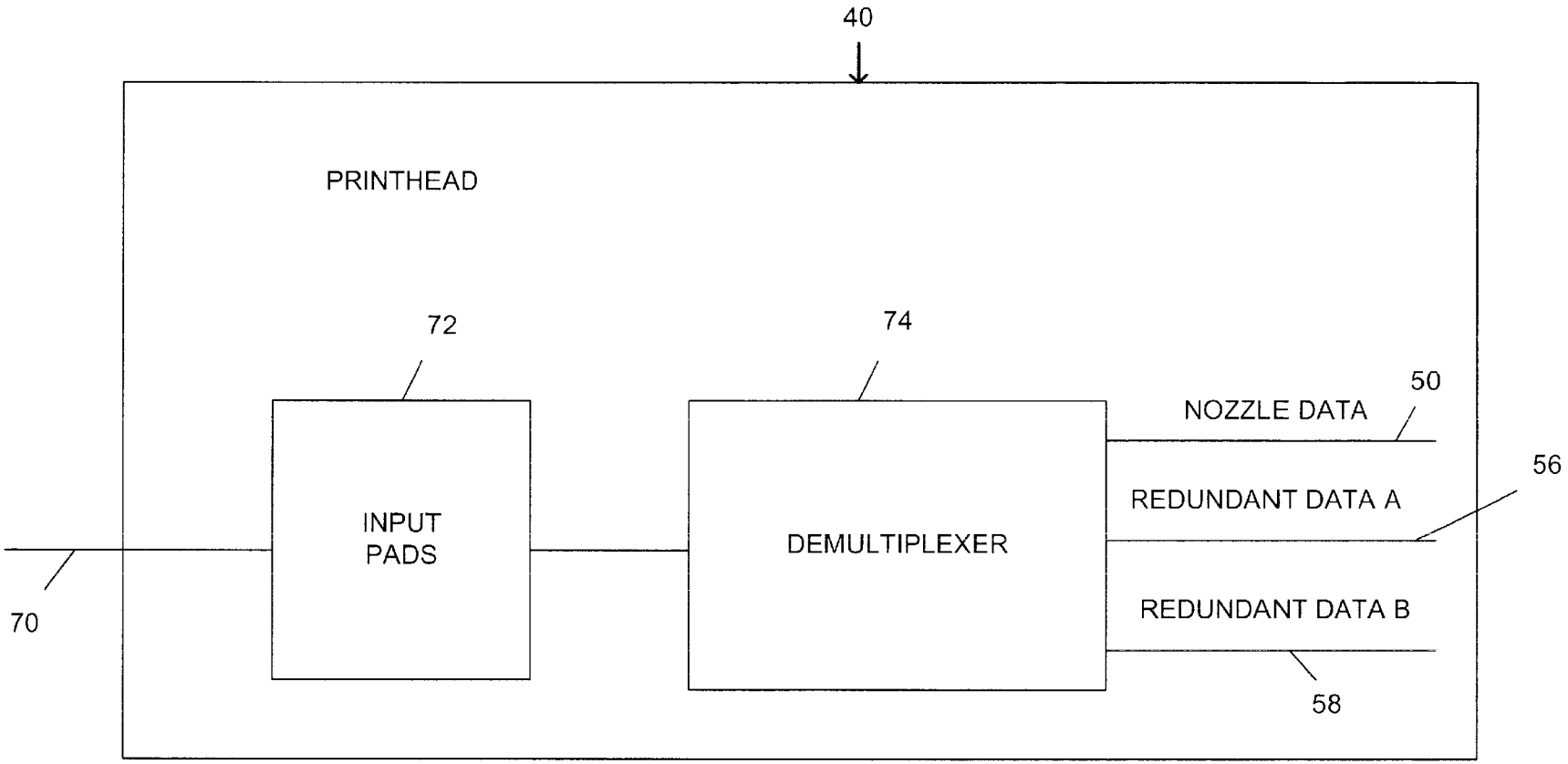
FIG. 4 is a block diagram illustrating portions of one embodiment of an inkjet printhead having shared nozzle data/redundant data input pads.

Portions of one embodiment of a printhead 40 according to the present invention are illustrated generally in block diagram form in FIG. 4. In this embodiment, printhead 40 includes nozzle data/redundant data input pads 72 which receive nozzle data and redundant data A and B from electronic controller 20 via a data path 70. In this embodiment, the output of the nozzle data/redundant data input pads 72 are demultiplexed by demultiplexer 74 to provide the nozzle data on path 50, the redundant data A on path 56, and the redundant data B on path 58. In this embodiment, the nozzle data/redundant data input pads 72 are used for redundant data during a configuration cycle to program redundancy flip-flop registers 106 and 206. After the configuration cycle, the nozzle data/redundant data input pads 72 are used to provide the nozzle data for normal printing operations.

Referring back to FIG. 3, the output of each nozzle logic 104*a*–104*n* is respectively provided to a first input of a corresponding AND gate 108*a*, 108*b*, . . . ,108*n*. The Q output of each redundancy flip-flop register 106*a*–106*n* is respectively provided to a second input of the corresponding AND gate 108*a*–108*n*. Similarly, the output of each nozzle logic 204*a*–204*n* is respectively provided to a first input of a corresponding AND gate 208*a*, 208*b*, . . . ,208*n*. The Q output of each redundancy flip-flop register 206*a*–206*n* is respectively provided to a second input of the corresponding AND gate 208*a*–208*n*. The outputs of AND gates 108*a*–108*n* are respectively provided to nozzles 113*a*–113*n* to control the firing of nozzles 113*a*–113*n*. Similarly, the outputs of AND gates 208*a*–208*n* are respectively provided to nozzles 213*a*–213*n* to control the firing of nozzles 213*a*–213*n*.

The operation of the nozzles and associated registers and logic 100 and 200 is as follows. Each nozzle 113 and 213 has a redundancy memory element or flip-flop register 106 or 206 associated to the nozzle which is configured once at the beginning of a printing operation and reconfigured as required to update redundancy information. The redundancy flip-flop registers 106 and 206 are employed to block or let pass any firing control information to the nozzles 113 and 213, based on whether or not the given nozzle has been determined by electronic controller 20 to be suitable to be employed for printing. The serial redundant data A and B data from electronic controller 20 is programmed into the redundancy flip-flop registers 106 and 206 during the configuration cycle by serially shifting the redundant data through the flip-flop registers with a shift register operation.

After the configuration of the redundancy flip-flop registers 106/206 only one nozzle 113/213 for a given nozzle number is to be fired across Columns A and B. In other words, if any given nozzle 113 within Column A is fired, its matching nozzle 213 within Column B is not to be fired and vice versa. This design can be extended to any number of columns being ganged together in the above manner, so long as only one nozzle for a given nozzle number is fired across all columns. In other words, if any given nozzle within a column is fired, its matching nozzles having the same nozzle numbers within the other multiple columns are not to be fired.

With the above redundancy design of printhead 40, the same nozzle data on line 50 can be sent to each column instead of sending unique data to each nozzle in each column. In a printing operation, nozzle data on line 50 is sent from electronic controller 20 as if printhead 40 had only one column and no redundancy. In the printing operation, the nozzle data is provided to both Columns A and B on path 50 internal to printhead 40.

Therefore, the above nozzle redundancy design reduces nozzle data rate or bandwidth by one-half. This reduction in nozzle data bandwidth to printhead 40 is achieved by configuring the redundancy flip-flop registers 106/206 to specify which nozzles 113/213 are redundant and which are operational.

Thus, the above redundancy logic and circuitry of printhead 40 according to the present invention reduces nozzle data rate or bandwidth by a factor of two or more for inkjet printheads that have multiple columns employed redundantly. The amount of reduced bandwidth tracks the number of columns of redundant nozzles. The significant reduction in nozzle data bandwidth to the printhead correspondingly significantly reduces the required number of conductors necessary to carry nozzle data between electronic controller 20 and printhead 40. In addition, the number of drivers in electronic controller necessary to transmit the nozzle data from electronic controller 20 to printhead 40 is also proportionally reduced. Moreover, the reduction in nozzle data bandwidth to the printhead according to the present invention also proportionally reduces the number of required nozzle data input pads on printhead 40 to receive the nozzle data from electronic controller 20.

Furthermore, the reduced number of nozzle data conductors in the electrical interconnect between electronic controller 20 and printhead 40 correspondingly reduces the amount of undesirable electromagnetic interference (EMI) conducted and/or radiated by the nozzle data conductors. In addition, if necessary, the reduced bandwidth permitted with the above redundancy configuration of the present invention could also allow for lower speed signaling of the nozzle data transmission from electronic controller 20 to printhead 40, which would correspondingly increase the signal integrity of the nozzle data signals conununicated from electronic controller 20 to printhead 40.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead comprising:

a first column of nozzles;

first nozzle column register and logic units configured to receive first serial nozzle data and to provide first nozzle firing control signals for controlling the firing of ink drops from the first column of nozzles;

a second column of nozzles;

second nozzle column register and logic units configured to receive the first serial nozzle data and to provide second nozzle firing control signals for controlling the firing of ink drops from the second column of nozzles;

first column redundancy logic configured to disable selected nozzles of the first column of nozzles from firing which correspond to selected nozzles of the second column of nozzles enabled for firing; and second column redundancy logic configured to disable selected nozzles of the second column of nozzles from firing which correspond to selected nozzles of the first column of nozzles enabled for firing.

2. The printhead of claim 1 wherein the first column of nozzles includes N nozzles and the second column of nozzles includes N nozzles.

3. The printhead of claim 2 wherein the first column of nozzles are numbered 1 through N, the second column of nozzles are numbered 1 through N, and the first and second column redundancy logic are configured to operate so that only one nozzle for a given nozzle number is enabled for firing across the first and second columns.

4. The printhead of claim 1 wherein the first and second column redundancy logic is programmable.

5. The printhead of claim 4 wherein the first column redundancy logic is configured to receive first redundant data for programming the first column redundancy logic and the second column redundancy logic is configured to receive second redundant data for programming the second column redundancy logic.

6. The printhead of claim 5 wherein the printhead further comprises:

first input pads configured to receive the first and second redundant data during a configuration cycle and to receive the nozzle data during a printing operation, and a demultiplexer coupled to the first input pads for providing the first and second redundant data to the first and second column redundancy logic during the configuration cycle and for providing the first nozzle data to first and second nozzle column register and logic units during the printing operation.

7. The printhead of claim 1 wherein the first column redundancy logic includes first memory devices for storing first redundancy states for the first column of nozzles, and the second column redundancy logic includes second memory devices for storing second redundancy states for the second column of nozzles.

8. The printhead of claim 7 wherein the first and second memory devices comprise flip-flop registers.

9. The printhead of claim 7 wherein the first column redundancy logic includes first combiners for combining the first redundancy states with the first nozzle firing control signals and the second column redundancy logic includes second combiners for combining the second redundancy states with the second nozzle firing control signals.

10. The printhead of claim 9 wherein the first and second combiners comprise AND gates.

11. A printhead assembly comprising:

at least one printhead, each printhead including:

a first column of nozzles;

first nozzle column register and logic units configured to receive first serial nozzle data and to provide first nozzle firing control signals for controlling the firing of ink drops from the first column of nozzles;

a second column of nozzles;

second nozzle column register and logic units configured to receive the first serial nozzle data and to provide second nozzle firing control signals for controlling the firing of ink drops from the second column of nozzles;

first column redundancy logic configured to disable selected nozzles of the first column of nozzles from firing which correspond to selected nozzles of the second column of nozzles enabled for firing; and second column redundancy logic configured to disable selected nozzles of the second column of nozzles from firing which correspond to selected nozzles of the first column of nozzles enabled for firing.

12. The printhead assembly of claim 11 wherein the at least one printhead includes multiple printheads.

13. A method of operating a printhead comprising:

receiving first serial nozzle data with first nozzle column register and logic units;

providing first nozzle firing control signals with first nozzle column register and logic units for controlling the firing of ink drops from a first column of nozzles;

receiving the first serial nozzle data with second nozzle column register and logic units;

providing second nozzle firing control signals with second nozzle column register and logic units for controlling the firing of ink drops from a second column of nozzles;

disabling selected nozzles of the first column of nozzles from firing which correspond to selected nozzles of the second column of nozzles enabled for firing; and disabling selected nozzles of the second column of nozzles from firing which correspond to selected nozzles of the first column of nozzles enabled for firing.

14. The method of claim 13 wherein the first column of nozzles includes N nozzles and the second column of nozzles includes N nozzles.

15. The method of claim 14 wherein the first column of nozzles are numbered 1 through N, the second column of nozzles are numbered 1 through N, and the disabling steps operate so that only one nozzle for a given nozzle number is enabled for firing across the first and second columns.

16. The method of claim 15 further comprising:

receiving first redundant data for programming first column redundancy logic; and receiving second redundant data for programming second column redundancy logic.

17. The method of claim 16 further comprising:

receiving the first and second redundant data at first input pads during a configuration cycle;

receiving the nozzle data at the first input pads during a printing operation;

providing the first and second redundant data from the first input pads to the first and second column redundancy logic during the configuration cycle; and providing the first nozzle data from the input pads to the first and second nozzle column register and logic units during the printing operation.

18. The method of claim 13 further comprising:

storing first redundancy states for the first column of nozzles; and storing second redundancy states for the second column of nozzles.

19. The method of claim 18 further comprising:

combining the first redundancy states with the first nozzle firing control signals; and combining the second redundancy states with the second nozzle firing control signals.

20. The method of claim 19 wherein the combining steps are performed with AND gates.

* * * * *

UNITED STATES PATENT AND TRADEMARK OFFICE

CERTIFICATE OF CORRECTION

PATENT NO. : 6,471,320 B2
DATED : October 29, 2002
INVENTOR(S) : Daryl E. Anderson It is certified that error appears in the above-identified patent and that said Letters Patent is hereby corrected as shown below:

Column 3 to Column 4, line 7,
Cancel beginning with "In one embodiment" to and including "to the printhead.".

Signed and Sealed this

Twenty-ninth Day of April, 2003

JAMES E. ROGAN
*Director of the United States Patent and Trademark Office*